US005842513A

United States Patent [19]

Maciaszek et al.

[11] Patent Number: 5,842,513

[45] Date of Patent: Dec. 1, 1998

[54] SYSTEM FOR TRANSFER OF ENERGY BETWEEN A HOT SOURCE AND A COLD SOURCE

[75] Inventors: Thierry Maciaszek, Montbrun Lauragais; Herve Huxtaix, Pin Justaret; Michel Feuillatre, Toulouse; Jacques Mauduyt, Auzeville, all of France

[73] Assignee: Centre National d'Etudes Spatiales, Paris, France

[21] Appl. No.: 797,510

[22] Filed: Jan. 29, 1997

Related U.S. Application Data

[63] Continuation of PCT/FR95/01004 Jul. 26, 1995.

[30] Foreign Application Priority Data

Jul. 29, 1994 [FR] France ..... 94 09459

[51] Int. Cl.[6] ..... F28D 15/00

[52] U.S. Cl. ..... 165/104.26; 165/42

[58] Field of Search ..... 165/104, 26, 104.22, 165/104.14, 104.21, 41, 104.33, 42

[56] References Cited

U.S. PATENT DOCUMENTS

| | | | |
|---|---|---|---|
| 3,889,096 | 6/1975 | Asselman et al. | 165/104.26 X |
| 4,312,402 | 1/1982 | Basiulius | 165/104.26 X |
| 4,899,810 | 2/1990 | Fredley | 165/104.14 X |
| 4,903,761 | 2/1990 | Cima | 165/104.26 X |
| 4,921,041 | 5/1990 | Akachi | 165/104.14 X |
| 5,016,705 | 5/1991 | Bährle et al. | 165/104.14 X |
| 5,036,905 | 8/1991 | Eninger et al. | 165/104.26 X |
| 5,103,897 | 4/1992 | Cullimore et al. | 165/104.26 X |
| 5,303,768 | 4/1994 | Alario et al. | 165/104.26 |

FOREIGN PATENT DOCUMENTS

| | | | |
|---|---|---|---|
| 0 351 173 | 1/1990 | European Pat. Off. . | |
| 001430709 | 10/1988 | U.S.S.R. | 165/104.26 |

OTHER PUBLICATIONS

D.R. Chalmers et al., Application of Capillary Pumped Loop Heat Transport Systems to Large Spacecraft, AiAA, pp. 1–11, Jun. 1986.

Patent Abstracts of Japan, vol. 9, No. 98 (M—375), Apr. 27, 1985.

"Two–Phase Bidirectional Heat Exchanger", NTIS Tech Notes Jun. 1991, Springfield, Va., p. 469.

*Primary Examiner*—Ira S. Lazarus
*Assistant Examiner*—Christopher Atkinson
*Attorney, Agent, or Firm*—Jacobson, Price, Holman & Stern, PLLC

[57] ABSTRACT

A hot source (A) contains one assembly comprised of at least one capillary evaporator (1A) and at least one condenser (2B) having condensation surfaces with a large curvature radius, and a cold source (B) containing an assembly of the same nature (1B, 2B). The condensers are interconnected by means of a steam conduit (3) and the capillary evaporators are interconnected by means of a liquid conduit (4) so as to form a closed circuit wherein circulates a metered fluid amount so that the complete evaporation takes place in the "hot" evaporators and the complete condensation takes place in the "cold" condensers, the other elements being then inactive. The system is reversible and, consequently, interesting gains of weight and room can be achieved for a spatial utilization.

4 Claims, 2 Drawing Sheets

SYSTEM FOR TRANSFER OF ENERGY BETWEEN A HOT SOURCE AND A COLD SOURCE

This application is a continuation of International Application No. PCT/FR95/01004 filed Jul. 26, 1995.

The present invention relates to a system for transfer of energy between a hot source and a cold source, employing a two-phase loop with capillary pumping.

Two-phase loops with capillary pumping exploit the following physical phenomenon: if a liquid which has suitable properties is sent to one end of a heated capillary tube, this liquid enters the capillary tube up to a point where it is totally vaporized. The surface of separation of the liquid and vapor phases has a curved shape and is called a "meniscus". At the meniscus level, in the vapor phase, an appreciable increase in pressure is observed, which can be employed for circulating the fluid in a closed circuit including, besides the evaporator capillaries, an appropriate condenser.

The phenomena arc the same if, instead of a capillary tube, a "capillary mass" is employed, that is to say a material exhibiting an open porosity with passages of substantially homogeneous dimensions, typically 2 to 20 micrometers.

This increase in pressure results from surface tension phenomena. It depends on the temperature and the nature of the fluid and on the solid walls with which it is in contact, and it is inversely proportional to the radius of the meniscus, or to the equivalent radius in the case where the meniscus is not spherical. The radius of the meniscus or the equivalent radius are themselves very closely related to the radius of the capillary or, more generally, to the radius of curvature of the solid surface in contact with which the change in state takes place. The increase in pressure is therefore negligible if the liquid-vapor interface is in contact with solid surfaces which have radii of curvature of some hundreds of micrometers.

In the present text reference is made to capillary evaporators and condensers. Each time, these terms can be applied to groups of capillary evaporators or of condensers arranged in parallel in the closed circuit.

To make the concept more definite, systems employing ammonia between −10 and +60° C. have been set up on this principle, with equivalent meniscus radii of the order of 10 micrometers; the pressure generated at the meniscus was of the order of 5 kPa, which suffices to compensate the pressure drops in the circuit. The condensers could consist either of radiators which radiate the energy toward space, or of exchangers coupled with other similar systems, or of phase-change devices such as boilers or evaporators, Such systems are today employed in the field of space technology.

These systems have the disadvantage of being capable of functioning in a closed circuit only in one direction, the capillary or capillaries being always placed in the hot source. Aboard space vehicles it so happens that heat transfers must be performed sometimes in one direction and sometimes in the opposite direction, for example in the case of daily or seasonal changes in sunshine. In this case it is necessary to install two independent loops functioning alternately and in inverse directions, and this complicates the equipment and increases its bulk.

The objective of the present invention is to provide equipment which permits transfers of energy in two opposed directions, in a simple manner and in a limited volume.

To obtain this result the invention provides a system for transfer of energy between a hot source and a cold source, the system including a capillary evaporator situated in the hot source and in which a fluid is introduced in the liquid state and changes integrally into the vapor state, a vapor conduit, a condenser situated in the cold source, where the fluid changes back into the liquid state, and a liquid conduit which returns the fluid to the capillary evaporator, the fluid circulating in closed circuit under the effect of the pressure generated at the meniscus constituting the liquid/vapor interfaces in the capillaries of the evaporator, this system having the particular feature that the closed fluid circuit includes two units each formed by a capillary evaporator connected to the liquid conduit and by a condenser inserted between the capillary evaporator and the vapor conduit, one of the units being placed in the hot source and the other in the cold source, and that the quantity of fluid is calculated in such a way that the evaporation takes place integrally in the capillary passages of the capillary evaporator situated in the hot source and that all the condensation takes place in the condenser situated in the cold source.

It will be understood that, in the hot source, the evaporation in the capillary evaporator creates the increase in pressure needed for setting the fluid in motion. In the cold source, if the condensation were to take place in the capillary evaporator, a pressure difference in the inverse direction would appear in the latter, and could be of the same order of magnitude, the difference in pressures depending chiefly on the differences in temperature between the hot and cold sources. In fact, as the condensation takes place in the condenser of the cold source, the capillary evaporator which follows it in the direction of circulation of the fluid behaves like a simple passive resistance, because its passages are completely filled with condensation liquid. The condensation on the condenser surfaces of large radius of curvature produces only inverse pressures which are practically negligible.

The filling of the circuit must be done with precision in order that the changes in state of the fluid should take place at the intended locations. Some degree of latitude is provided by the length of the passages in the capillary evaporator and the dimensions of the condenser. This latitude can be exceeded in the case, for example, of a lowering of the temperature of the liquid, resulting in a contraction of the latter. It has surprisingly been found that, even in this case, which corresponds to an "underfilling", the system continues to function correctly when a bubble of vapor has formed on the side of the capillary evaporator which is normally in contact with the liquid, and does so as long as this bubble is completely separated from the vapor conduit by liquid retained by capillarity in the capillary evaporator.

Provision can therefore be made for the quantity of fluid to be calculated in order that, in all the conditions of operation, at least one liquid-vapor interface is present in the capillary evaporator, it being nevertheless possible for a bubble of vapor without communication with the vapor conduit to be present, possibly on the liquid side of the capillary evaporator.

According to an advantageous embodiment, in the case where the capillary evaporator consists of a mass with controlled porosity in which the liquid can be vaporized with formation of menisci of small radius or equivalent radius, this mass being placed in a vessel between two chambers, one being connected to the liquid conduit and the other to the vapor conduit, the condenser of the cold source consists at least partially of that one of said chambers which is connected to the vapor conduit. In the case where all the condensation can take place in this chamber, that is to say within the vessel of the capillary evaporation device in the common meaning of the term, a remarkably simple and compact unit is obtained.

According to a more highly improved embodiment, there are a number of hot sources and/or a number of cold sources, and there is at least one of said units formed by a capillary evaporator and by a condenser in each hot source and each cold source.

It has been found, unexpectedly, that the system stabilizes itself even with appreciable differences in temperature between the hot sources or between the cold sources.

The invention will be described in a more detailed manner with the aid of practical examples illustrated by the drawings, among which:

FIG. 1 shows a basic diagram of a system intended to transfer heat energy from a zone A, called "hot source", toward a zone B, at lower temperature, called "cold source".

Figure 1:
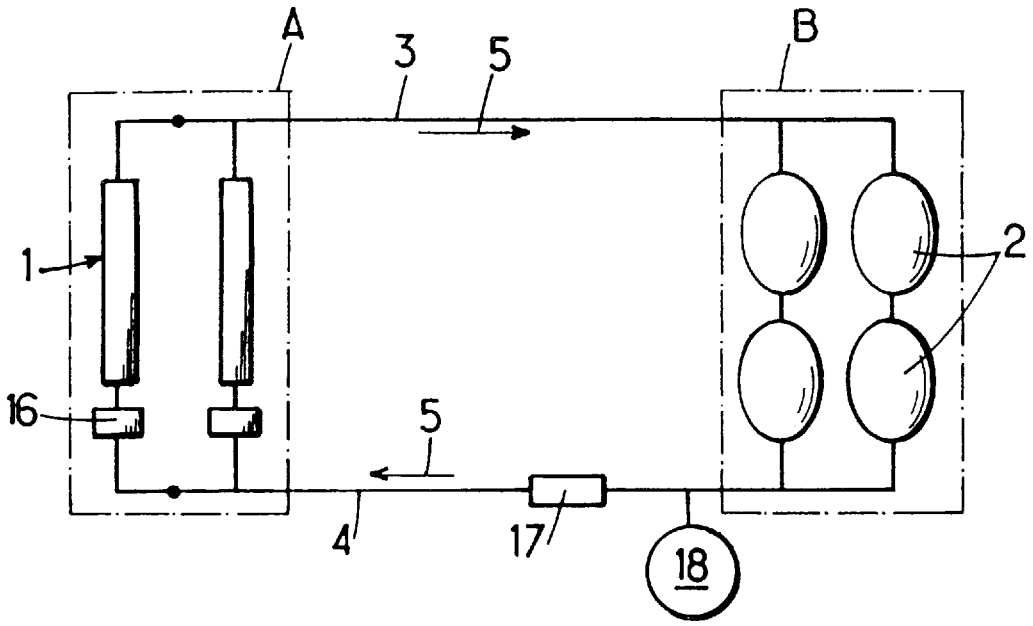
FIG. 1 (PRIOR ART)
FIG. 1 is a basic diagram of a system of the prior art.

This system includes a closed circuit in which there circulates a fluid, which may, according to the temperatures of use, be water, ammonia, a "Freon" or the like. This circuit includes capillary evaporation devices 1 connected in parallel, condensers 2, also connected in parallel (or parallel series), a vapor circulation conduit 3 and a liquid circulation conduit 4. The direction of circulation of the fluid is shown by the arrows 5.

Figure 3:
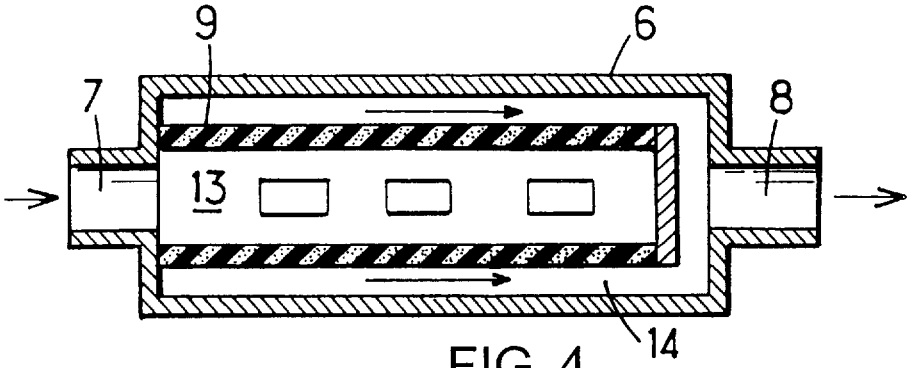
FIG. 3 (PRIOR ART)
FIGS. 3 and 4 are, respectively, a lengthwise section and a cross section of a capillary evaporation device of the usual technology.
Figure 4:
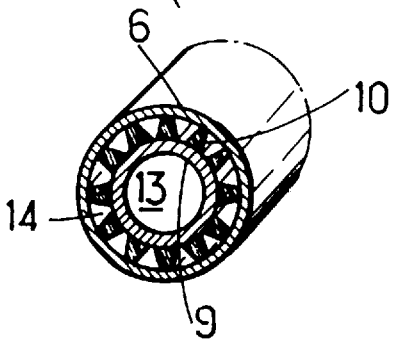
FIG. 4 (PRIOR ART)

FIGS. 3 and 4 show the structure of a capillary evaporation device in common use.

This device includes a metal tube 6 which has an entry 7 at one end and an exit 8 at the opposite end. Inside the tube a cylinder of porous material 9 is supported by spacers 10 coaxially with the tube 6. This porous material consists of parallel fibers arranged so as to form between them passages of controlled maximum size, for example of the order of 20 micrometers, and forming what is known as a "capillary wick".

The porous material may consist of any material which has pores of suitable dimensions and which are substantially homogeneous, for example sintered metal or plastic materials or ceramics.

Figure 5:
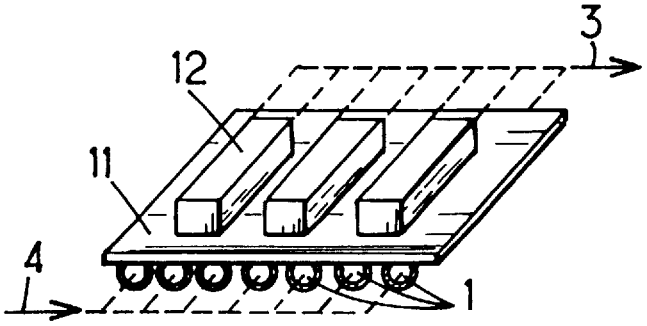
FIG. 5 is a diagram, in perspective, of the arrangement of a number of capillary evaporation devices.

FIG. 5 shows a hot source consisting of a plate 11 on one face of which are mounted pieces of equipment 12 which release heat and/or which it is desired to cool. On the opposite face of the plate are secured capillary evaporation devices 1 the entry 7 of which is connected to a liquid conduit 5 and communicates with the internal cavity 13 (see FIG. 4) of the capillary wick 9, and the exit 8 of which is connected to a vapor conduit 3 and communicates with the annular space 14 situated between the tube 6 and the capillary wick 9.

Figure 6:
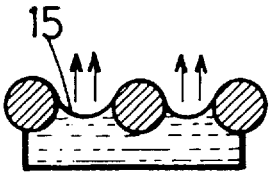
FIG. 6 is a diagram showing a meniscus.

In normal operation the internal cavity 13 is filled with liquid and the annular space 14 is filled with vapor. The liquid-vapor interface consists of a set of menisci 15 (see FIG. 6), of substantially equal equivalent radii, which are all within the thickness of the porous mass 9.

In customary technology, the capillary evaporation devices which have just been described are known as "capillary evaporators". From the above it follows that, within the meaning of the present text, only the porous mass 9 therefore constitutes the actual capillary evaporator, the cavity 13 and the space 14 being, functionally, extensions of the liquid conduit or of the vapor conduit.

The setting in circulation of the fluid is due to the increase in the pressure of the vapor, in the capillary evaporators, which is generated at the menisci where the complete vaporization of the liquid takes place. As it passes through the capillary wick, the liquid heats up very rapidly (the flow rates are very low) and is completely vaporized at the menisci at virtually constant temperature. The increase in the pressure is proportional to the surface tension of the fluid and inversely proportional to the equivalent radius of the menisci (the work being done with radii smaller than 10 $\mu$m). The flow rate of fluid in each evaporator is thus constantly self-adjusted in order to have only pure vapor at the exit of each evaporator.

To have a correct functioning of the capillary evaporators it is essential to have only liquid at the entry of each capillary evaporation device. These devices can therefore be arranged only in parallel. In addition, an isolator 16 (FIG. 1) must be positioned at the entry of each evaporator. The purpose of this isolator is to prevent a return of vapor (in the main tube of liquid in the loop) that could occur in an evaporator during an accidental loss of priming (for example during an excessively high power injection).

The pure vapor is carried toward the condensers 2 where the extraction of the energy acquired by the fluid is performed, either by radiators (which radiate the energy toward space) or by exchangers coupled with other loops, or by phase-change systems such a. Boilers or evaporators.

Returning to the device in FIG. 1, a supercooler 17 is positioned on the liquid exit tube. The function of this supercooler is to condense the vapor which, accidentally, in the case of abnormal situations, might not have been completely condensed at the exit of one of the last condensers.

The operating temperature of the loop is controlled by a two-phase pressurizer storage container 18. This storage container is thermally controlled (heating and cooling system) so as to ensure a control of its vaporization temperature, which is also the temperature of vaporization at the "cold plates" 11 and exchangers (to within the pressure drops, which are very small).

With this type of loop a set temperature can be controlled with good accuracy (better than a degree in most cases), this being whatever are the variations in power to which the loop is exposed at the evaporators or condensers.

The maximum power which it is possible to convey is conditioned by the maximum pressure rise which the capillary evaporators can ensure and by the sum of the pressure drops in the circuit for the maximum power considered. With ammonia and equivalent meniscus radii of 10 $\mu$m, pressure rises of the order of 5,000 Pa can be achieved.

Figure 2:
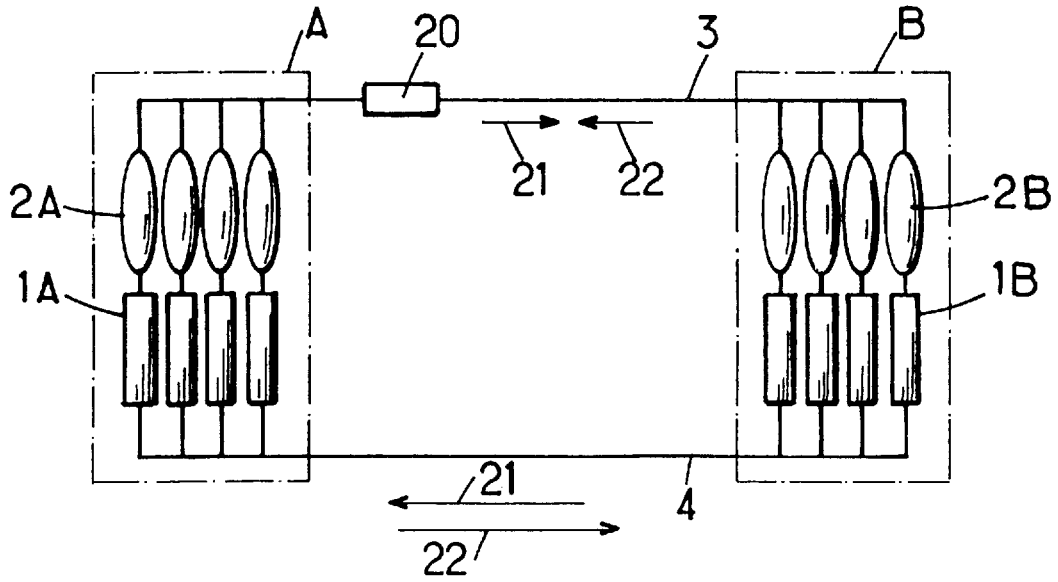
FIG. 2 is a basic diagram of a system according to the invention.

FIG. 2 shows the diagram of an energy transfer system in accordance with the invention.

In each of the sources A and B the circuit includes units, each consisting of a capillary evaporator 1A, 1B in series with a condenser 2A, 2B, a vapor conduit 3 being connected to each of the condensers 2A, 2B, and a liquid conduit 4 being connected to each of the capillary evaporators 1A, 1B. A means for heating the low-power vapor circuit 20 is provided. There is no pressurizer storage container 18 and no isolators 16.

When the temperature of the source A is higher than that of the source B, the direction of circulation of the fluid is that shown by the arrows 21. The evaporators 1A are active. The liquid at the entry of the evaporators, passes through the capillary wicks 9 and is vaporized therein. The vapor leaves each evaporator device (with an increase in capillary pressure) and passes through the "hot" condensers 2A which are therefore inactive. The vapor is collected at the exit of these condensers an(i is carried in a tube 3 as far as the entry of the "cold" condensers 2B. The is vapor is condensed partially or completely in these condensers. A two-phase or single-phase liquid mixture therefore enters the evaporator devices 1B "countercurrentwise" in relation to an operation that is normal for an evaporator. The remaining vapor is condensed completely in the annular space 14 of the evaporator devices 1B. Liquid alone leaves these evaporators. The liquid is collected and is conveyed in the tube 4 as far as the entry of the evaporators 1A, and this closes the loop. A partial vaporization of the liquid may be temporarily permitted in the liquid tube.

When the source B becomes hotter than the source A, the direction of circulation of the fluid is that of the arrows 22. It is the evaporators 1B that act, as intended, as evaporators, the condensers 2B are inactive, the condensers 2A are active and the evaporator devices 1A act as supplementary condensers at their annular space 14.

These annular spaces, which are enclosed in the capillary evaporation devices, then, from the functional point of view, form part of the condensers 2A.

When it is desired to produce a heat transfer between the various sources and when the transfer does not take place, the vapor tube 3 should be heated slightly (typically with 1 W/m) with the aid of the heating device 20, typically for an hour, in order to expel the liquid which could be present therein.

In the cases in which the condensation capacities of the annular spaces 14 of the inactive evaporators are sufficient, all the condenser can be eliminated. The loop then consists solely of conventional evaporation devices, some functioning as evaporators, the others as condensers.

The concept proposed for two heat sources can be extended to a multi-source concept (it is possible to have a different source per "evaporator-condenser", the system will adapt itself). It is also no longer necessary for the capillary evaporators 1A, 1B or the condensers 2A, 2B of the sources A and B to be identical in number or in performance, or for the number of evaporator-condenser units to be the same in all the sources.

In the field of space technology, the system according to the invention can be employed for producing a heat transfer between the various parts of a space vehicle which are subjected to different heat flows as a function of the time (daily or seasonal sunshine, heat dissipation, etc.). The advantages of this type of loop when compared with the present concept consist essentially in the possibility of producing two-directional heat transfers with a single loop, and this contributes to a simplification and to a reduction in the mass balance.

We claim:

1. A system for transfer of energy between a hot source and a cold source, the system including a capillary evaporator situated in the hot source, and in which a fluid is introduced in the liquid state and changes integrally into the vapor state inside capillary passages, a vapor conduit, a condenser situated in the cold source where the fluid changes back into the liquid state while condensing on surfaces of large radius of curvature, and a liquid conduit which returns the fluid to the capillary evaporator, the fluid circulating in closed circuit under the effect of the pressure generated at the meniscus constituting the liquid/vapor interfaces in the capillary passages of the evaporator, in which:

the closed fluid circuit includes two units each formed by a capillary evaporator connected to the liquid conduit and by a condenser inserted between the capillary evaporator and the vapor conduit, one of the units being placed in the hot source and the other in the cold source;

and the quantity of fluid is calculated in such a way that the evaporation takes place integrally in the capillary passages of the capillary evaporator situated in the hot source and that the condensation takes place in the condenser situated in the cold source.

2. The system as claimed in claim 1, wherein the quantity of fluid is calculated in order that, in all the conditions of operation, at least one liquid-vapor interface is present, it being nevertheless possible for a bubble of vapor without communication with the vapor conduit to be present, possibly on the liquid side of the capillary evaporator.

3. The system as claimed in claim 1, wherein the capillary evaporator consists of a mass with controlled porosity in which the liquid can be vaporized with formation of menisci (15) of small radius or equivalent radius, this mass being placed in a vessel between two chambers (13,14), one being connected to the liquid conduit and the other to the vapor conduit (3), and the condenser of the cold source consists at least partially of that one (14) of said chambers which is connected to the vapor conduit (3).

4. The system as claimed in claim 1, wherein there are a number of hot sources and/or a number of cold sources, and at least one of said units formed by a capillary evaporator and by a condenser is provided in each hot source and each cold source.

* * * * *